US009732918B2

(12) United States Patent
Wang

(10) Patent No.: US 9,732,918 B2
(45) Date of Patent: Aug. 15, 2017

(54) LED LAMP STRING AND HOSE LAMP THEREOF

(71) Applicants: Chenglun Wang, Toufen Town, Miaoli Country (TW); Luhua Chang, Yung Kang District, Tainan (TW)

(72) Inventor: Chenglun Wang, Toufen Town (TW)

(73) Assignee: Luhua Chang, Tainan (TW)

( * ) Notice: Subject to any disclaimer, the term of this patent is extended or adjusted under 35 U.S.C. 154(b) by 36 days.

(21) Appl. No.: 14/950,075

(22) Filed: Nov. 24, 2015

(65) Prior Publication Data

US 2016/0238218 A1 Aug. 18, 2016

(30) Foreign Application Priority Data

Feb. 13, 2015 (CN) ..... 2015 2 0112376
Jul. 24, 2015 (CN) ..... 2015 2 0546931

(51) Int. Cl.

| | |
|---|---|
| ***F21V 19/00*** | (2006.01) |
| ***F21S 4/00*** | (2016.01) |
| ***F21L 14/02*** | (2006.01) |
| *F21Y 103/10* | (2016.01) |
| *F21Y 115/10* | (2016.01) |

(52) U.S. Cl.
CPC ..... *F21L 14/026* (2013.01); *F21Y 2103/10* (2016.08); *F21Y 2115/10* (2016.08)

(58) Field of Classification Search
CPC ..... F21L 14/026; F21V 19/0025; F21S 4/28
See application file for complete search history.

(56) References Cited

U.S. PATENT DOCUMENTS

2003/0193803 A1* 10/2003 Lin ..... F21S 4/26 362/249.04
2011/0096545 A1* 4/2011 Chang ..... F21S 4/28 362/249.02
2012/0032587 A1* 2/2012 Shih ..... F21S 4/26 315/32

* cited by examiner

*Primary Examiner* — Thomas M Sember
(74) *Attorney, Agent, or Firm* — Welsh Flaxman & Gitler LLC

(57) ABSTRACT

The invention discloses a novel LED lamp string and a hose lamp therewith, wherein, the serial lighting LED lamp string is formed by serial connection of a plurality of connection wires and a plurality of LED lighting chips, the front ends of the connection wires at two sides are respectively welded on the lower end surface electrifying welding areas, block pins facing the outside are formed at the tails of the front ends of the connection wires, each LED lighting chip, the welded points of the connection wires at two corresponding sides thereof and the corresponding block pins are tightly wrapped and plastic-packaged by small insulation plastic bodies. The hose lamp saves materials and is firm and reliable and simple in machining process.

9 Claims, 7 Drawing Sheets

LED LAMP STRING AND HOSE LAMP THEREOF

CROSS-REFERENCE TO RELATED APPLICATIONS

This application claims the benefit of priority to Chinese Patent Application No. 201520112376.1 filed Feb. 13, 2015, and to Chinese Patent Application No. 201520546931.1 filed Jul. 24, 2015, the entirety of which prior filed applications are hereby incorporated by reference.

FIELD OF THE INVENTION

The invention relates to a LED (light emitting diode) decoration lamp string and a novel hose lamp using the lamp string.

BACKGROUND OF THE INVENTION

At present, for LED decoration lamp strings and hose lamps using the LED decoration lamp strings used in various occasions, the lighting LED lamp strings arranged in a core wire are commonly implemented by adopting a parallel electric connection manner, and as a parallel structure is realized by adopting dual electric wires, material waste is caused, and weight of the hose lamp is increased.

In addition, as shown in FIG. 13, in the past, a few of manufacturers adopt an LED serial manner of a structure formed by two enameled wires, and chips are placed transversely, one of the enameled wires is cutoff and is then fixed by glue (for example, the reference number 80 in the Figure), so that a serial manner is formed, and in a manufacturing process, besides waste of the enameled wires, the chips need to be arranged forwards and backwards, and the manufacturing process is complex.

In addition, the applicant of the invention disclosed a novel lamp string in an application named as "novel LED lamp string and a hose lamp thereof" applied on February 2015, the lamp string with such structure firstly adopts a serial lamp body structure, thus, the material of wires is effectively reduced, and cost is reduced. On the other hand, as the serial lamp string adopts a tight structure that a connection wire is provided with a block pin, the welded points of connection wires at two corresponding sides of each LED lighting chip (crystal) and the block pin are tightly plastic-packaged and wrapped by a small insulation plastic body, the firmness between the wires and the lighting chip is greatly enhanced, easiness in breaking is avoided, the structure is reliable and a machining process is simple.

The applicant researches and develops based on the technique above, and provides more preferable design schemes for users.

SUMMARY OF THE INVENTION

Aiming at the problems discussed above, the invention intends to provide an LED lamp string which is low in cost, film in structure and reliable in use and a hose lamp using the LED lamp string.

The invention adopts a technical scheme as follows:

A novel LED lamp string is a serial light emitting LED lamp string, which is formed by serial connection of a plurality of connection wires coated with insulation films and a plurality of LED light emitting chips respectively welded between adjacent connection wires, each LED light emitting chip comprises a chip body and a wiring bottom plate fixedly arranging the chip body, the lower end surface of the wiring bottom plate is straight and flat and is provided with two lower end surface electrifying welding areas, the front ends of the connection wires at two sides are respectively welded on the lower end surface electrifying welding areas, block pins facing the outside are formed at the tails of the front ends of the connection wires, each LED lighting chip, the welded points of the connection wires at two corresponding sides thereof and the corresponding block pins are tightly wrapped and plastic-packaged by small insulation plastic bodies, and the block pins are clamping sections formed by flattening or clamping sections formed by winding and bending.

Preferably, extending sections for connecting the wires with the LED lighting chips are downward slope sections and form slope sections.

Preferably, more than one half of the slope sections are wrapped by the small insulation plastic bodies, so one connection wire can realize electric serial connection, and firm and reliable extents are ensured without easily disconnection.

Preferably the block pins can be formed by bending or cutting in a process of machining and disconnecting a whole connection wire.

Preferably, the block pins can be clamping sections formed by flattening or clamping sections formed winding and bending.

A novel hose lamp is formed by a front connector, a tail plug, a hose and at least one serial lighting LED lamp string arranged in a through slot of the hose, the hose is plastic-packaged by two main wires, the connection wires connected with two ends of the serial lighting LED lamp string are respectively connected with corresponding main wires, the serial lighting LED lamp string is formed by serial connection of a plurality of connection wires wrapped by insulation films and a plurality of LED lighting chips respectively welded between adjacent connection wires, each LED lighting chip comprises a chip body and a wiring bottom plate for fixedly arranging the chip body, the lower end surface of the wiring bottom plate is straight and flat, and is provided with two lower end surface electrifying welding areas, the front ends of the connection wires at two sides are respectively welded on the lower end surface electrifying welding areas, block pins facing the outside are formed at the tails of the front ends of the connection wires, each LED lighting chip, the welded points of the connection wires at two corresponding sides thereof and the corresponding block pins are tightly wrapped and plastic-packaged by small insulation plastic bodies, and the block pins are clamping sections formed by flattening or clamping sections formed by winding and bending.

The invention has the beneficial effects that: on one hand, a serial lamp body structure is adopted in the hose lamp, so a wire material is effectively reduced, and the cost is reduced; on the other hand, as the serial lamp string adopts a tight structure that the connection wires are provided with block pins, the welded points of connection wires at two corresponding sides of each LED lighting chip and the block pin are tightly plastic-packaged and wrapped by a small insulation plastic body, the firmness between the wires and lighting chips is greatly enhanced, easiness in breaking is avoided, the structure is reliable and a machining process is simple.

BRIEF DESCRIPTION OF THE DRAWINGS

The invention is further described in combination with the following figures.

DETAILED DESCRIPTION OF THE EMBODIMENTS

Figure 1:
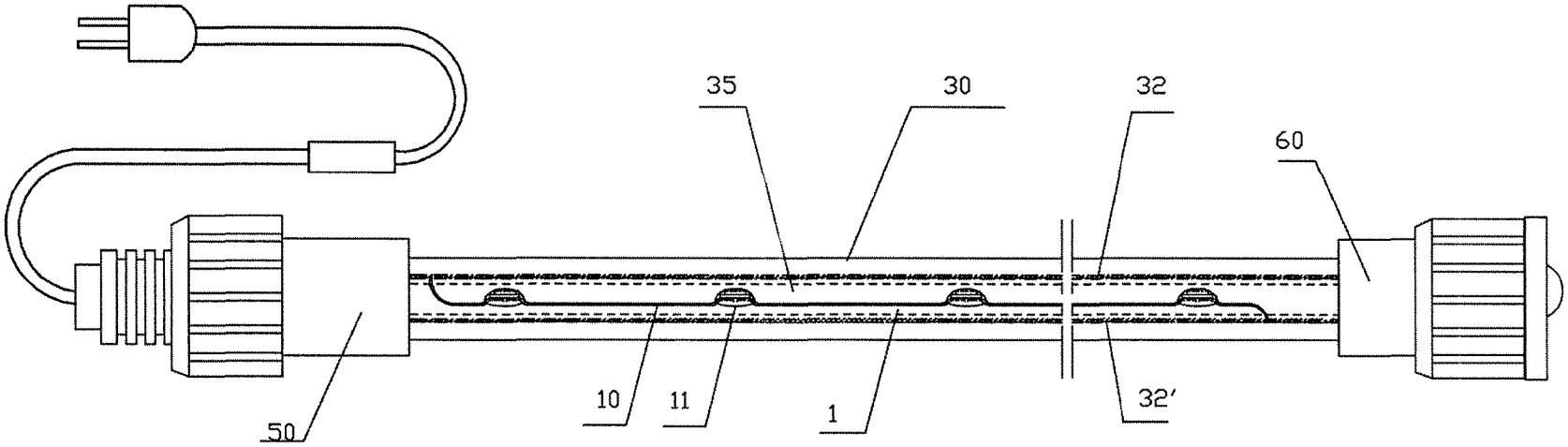
FIG. 1 is a structure schematic diagram of the invention.
Figure 2:
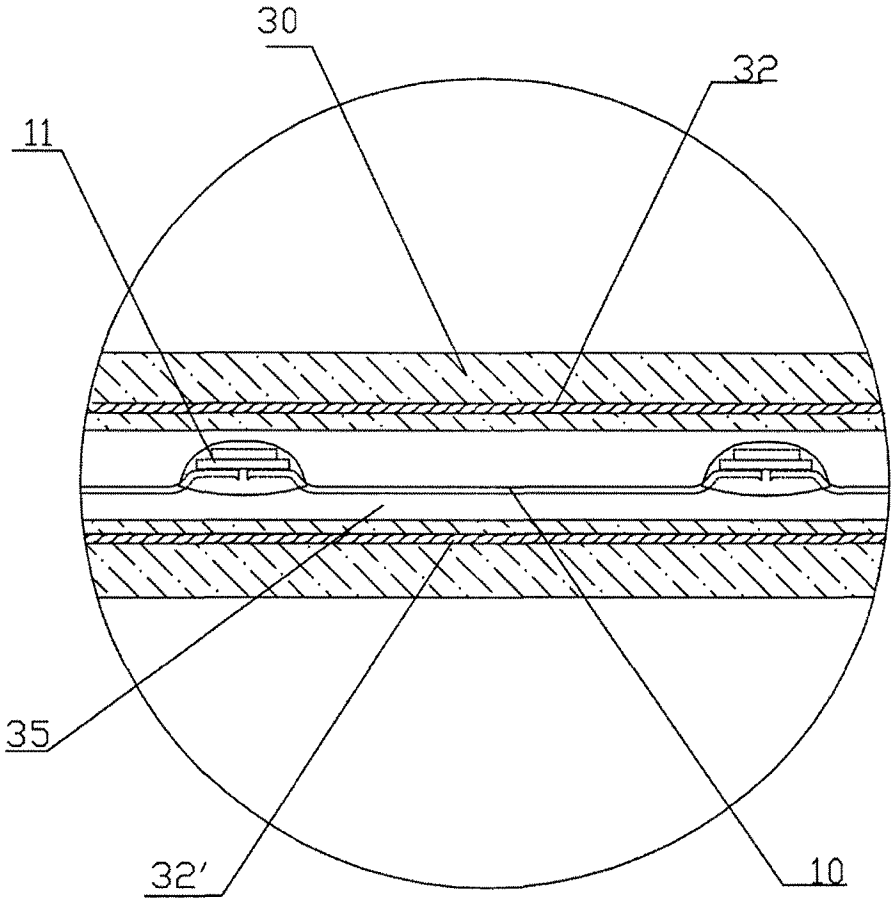
FIG. 2 is an amplifying schematic diagram of a hose lamp.
Figure 3:
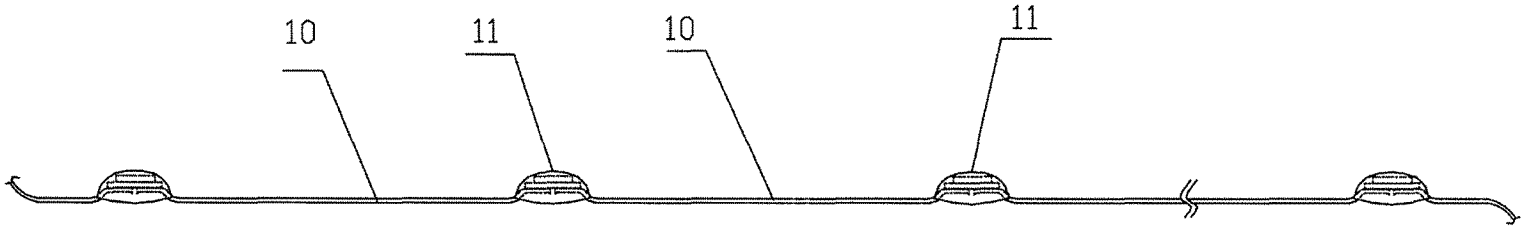
FIG. 3 is a structure schematic diagram of a serial lighting LED lamp string of the invention.
Figure 4:
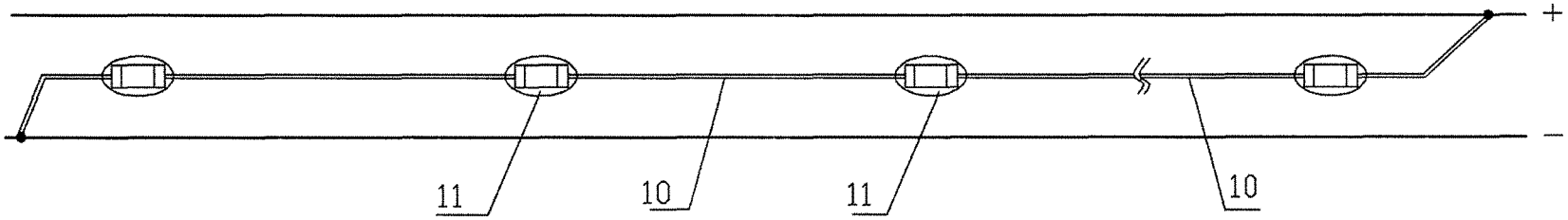
FIG. 4 is a schematic top view of the serial lighting LED lamp string of the invention (a main connection wire)

With reference to FIGS. 1-12, the invention discloses a novel LED lamp string and a novel hose lamp applying the lamp string. The hose lamp is formed by a front connector 50, a tail plug 60, a hose 30 and at least one serial lighting LED lamp string 1 arranged in a through slot 35 of the hose 30. Two main wires 32 and 32' are plastic-packaged on the hose 30, and connection wires connected with two ends of the serial lighting LED lamp string 1 are respectively connected with the corresponding main wires 32 and 32'.

Wherein, the LED lamp string is a serial lighting LED lamp string 1, and the serial lighting LED lamp string 1 is formed by serial connection of a plurality of connection wires 10 wrapped by insulation films and a plurality of LED lighting chips 11 respectively welded between adjacent connection wires 10.

Figure 5:
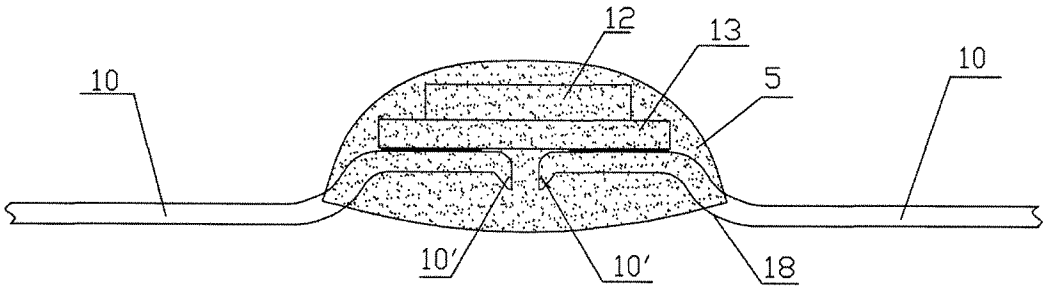
FIG. 5 is a schematic diagram of a connection structure between a LED lighting chip and a connection wire.
Figure 6:
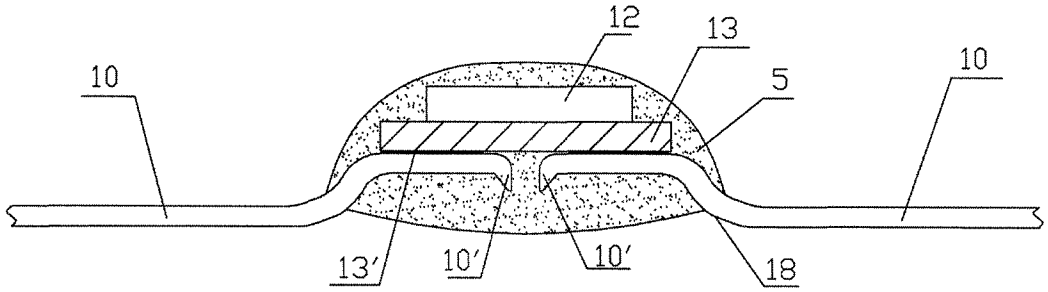
FIG. 6 is a section view schematic diagram of the connection structure between the LED lighting chip and the connection wire.
Figure 7:
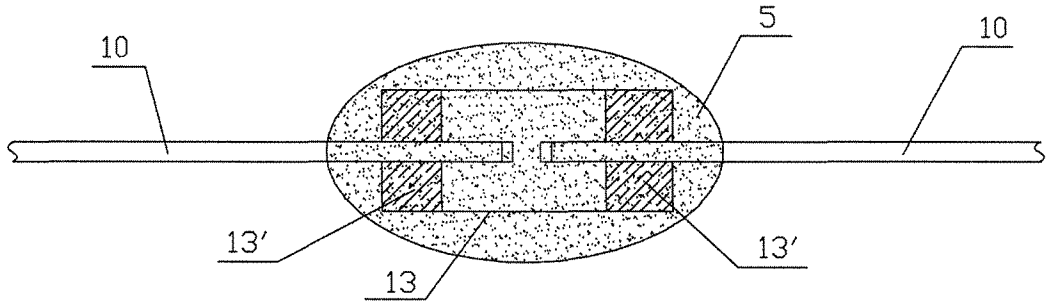
FIG. 7 is a schematic top view of the connection structure between the LED lighting chip and the connection wire.
Figure 8:
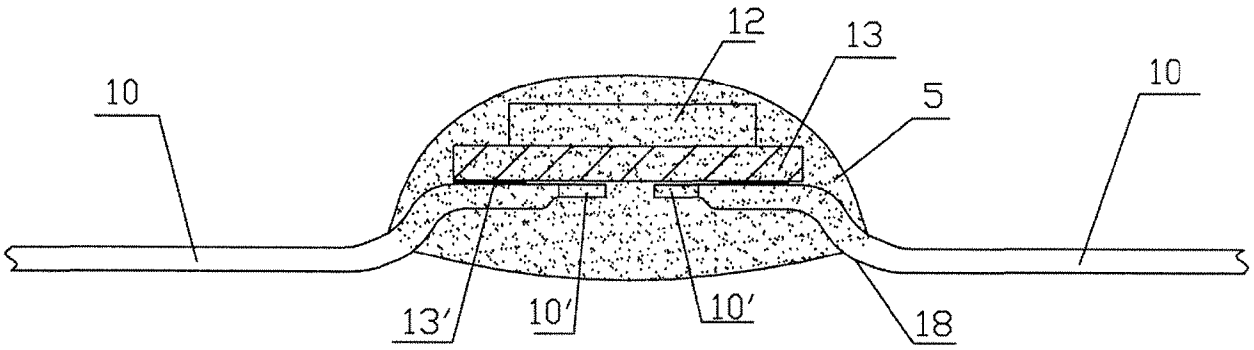
FIG. 8 is a schematic diagram of the connection structure between the LED lighting chip and the connection wire (in an embodiment that a block pin is formed by flattening)
Figure 9:
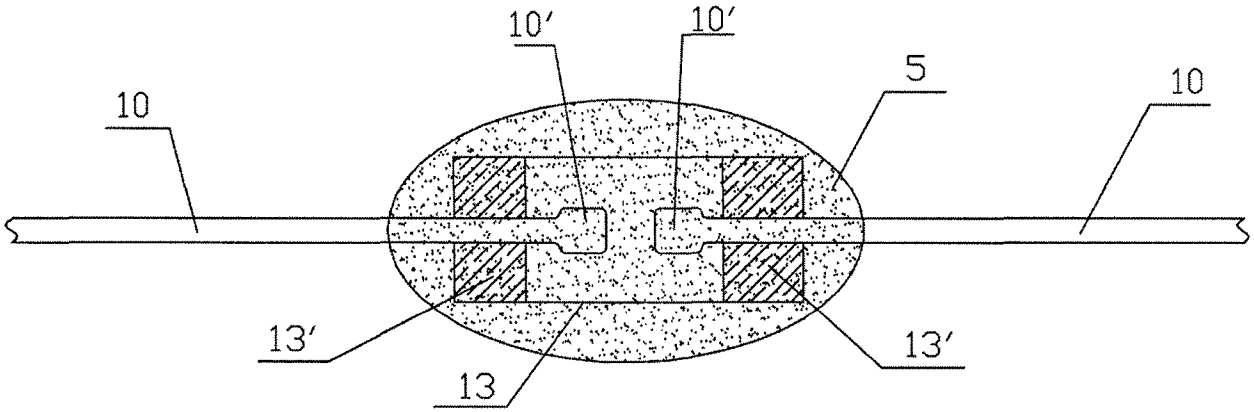
FIG. 9 is a schematic diagram of the connection structure between the LED lighting chip and the connection wire (in the embodiment that a block pin is formed by flattening)

With reference to FIGS. 5, 6 and 7, each LED lighting chip 11 comprises a chip body 12 and a wiring bottom plate 13 for fixedly arranging the chip body 12. The lower end surface of the wiring bottom plate 13 is straight and flat, and is provided with two lower end surface electrifying welding areas 13'. Specifically, a welding process can be performed by an elargol material (silver plastic). Block pins 10' facing the outside are formed at the tails of the front ends of the connection wires 10. The block pins 10' can be formed by bending or cutting in a process of machining and disconnecting a whole connection wire. And each LED lighting chip 11, the welded points of the connection wires 10 at two corresponding sides thereof and the corresponding block pins 10' are tightly wrapped and plastic-packaged by small insulation plastic bodies 5.

Of course, the block pins 10' can be preferably formed by clamps or other devices after the connection wire is cutoff. For example, with reference to FIGS. 8 and 9, the front ends of the connection wires 10 are flattened by a die, and the block pins 10' with cake-like clamping sections can make the structure of lamp string more fixed.

Figure 10:
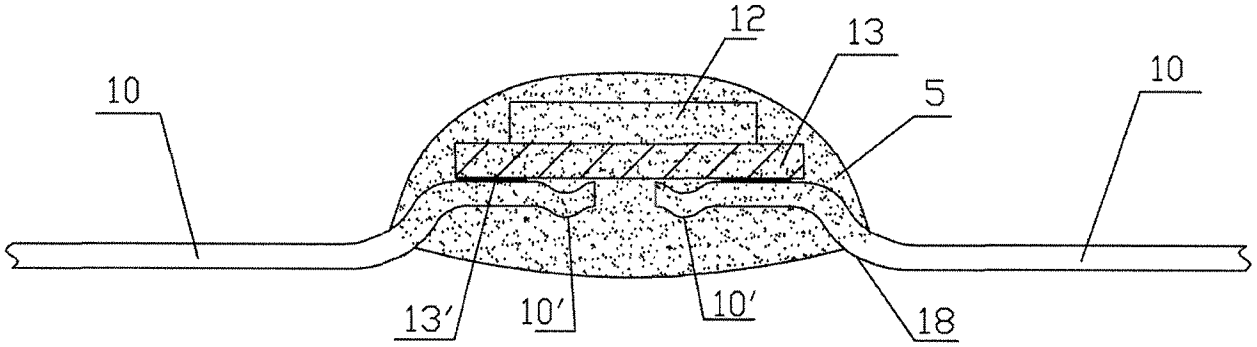
FIG. 10 is a schematic diagram of the connection structure between the LED lighting chip and the connection wire (in an embodiment that a block pin is formed by winding and bending and is bent up and down)
Figure 11:
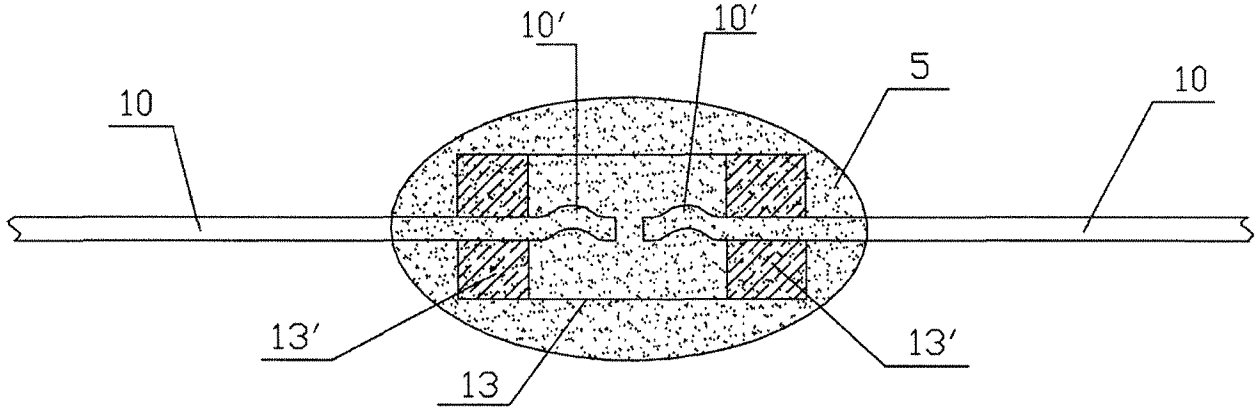
FIG. 11 is a schematic diagram of the connection structure between the LED lighting chip and the connection wire (in an embodiment that a block pin is formed by winding and bending and is bent horizontally)

Also with reference to FIGS. 10 and 11, the front ends of the connection wires 10 at two sides pass through the block pins 10' of the clamping sections formed by winding and bending. They may pass through the block pins 10' with the clamping sections formed by winding and bending up and down as FIG. 10, and may pass through the block pins 10' with the clamping sections formed by winding and bending horizontally as FIG. 11. Of course, the block pins can be wound and bent by other angles instead of a horizontal and up-and-down manner, and due to these manners, the lamp structure can be fixed well. The adopted structure manner that the block pins are provided with the clamping sections formed by flattening or winding and bending is a very preferable technical means for solving the technical problem of the invention.

Preferably, extending sections for connecting the wires 10 with the LED lighting chips 11 are downward sloped, and form slope sections 18.

More than one half of the slope section is wrapped by the small insulation plastic body 5, so the bottom is more tightly wrapped.

Figure 12:
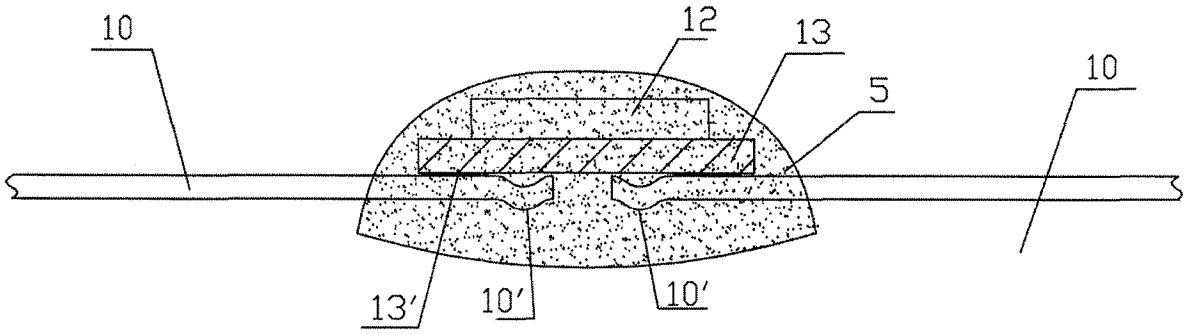
FIG. 12 is a schematic diagram of an embodiment that a connection extending section is a straight.
Figure 13:
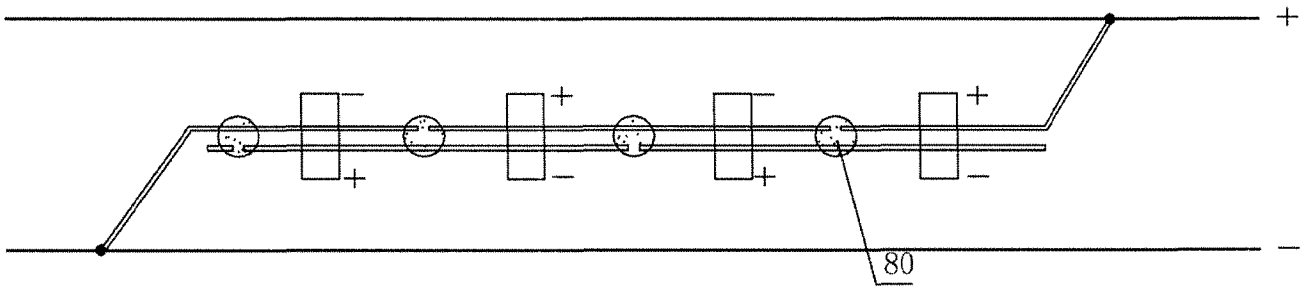
FIG. 13 is a structure schematic diagram of a use principle of an existing serial LED lamp string in the hose lamp.

Of course, the extending sections for connecting the wires 10 with the lighting chips 11 are straight as shown in FIG. 12.

Wherein, the connection wires 10 wrapped by insulation films are enameled wires.

Preferably, the LED lighting chips 11 are strip-shaped, the long ends thereof and the lamp string are in the same direction, and the LED lighting chips are more compact in structure, and more firm and reliable when being stressed.

Preferably, the front ends of the connection wires 10 wrapped by the insulation films to be welded on the same lighting LED chips 11 go deep into and get close to the straight and flat center of the lower end surface of the wiring bottom plate 13, so as to achieve the aim of being tightly wrapped by the small plastic body 5, and the two front ends are still insulated without conduction.

Of course, the above embodiments are not limitations to the invention, and other equal technical schemes should be in the protection scope of the invention.

The invention claimed is:

1. A novel LED lamp string, characterized in that: the LED lamp string is a serial lighting LED lamp string and is formed by serial connection of a plurality of connection wires (10) wrapped by insulation films and a plurality of LED lighting chips (11) respectively welded between adjacent connection wires (10), each LED lighting chip (11) comprises a chip body (12) and a wiring bottom plate (13) for fixedly arranging the chip body (12), a lower end surface of the wiring bottom plate (13) is straight and flat, and is provided with two lower end surface electrifying welding areas (13'), front ends of the connection wires (10) at two sides are respectively welded and fixed on the lower end surface electrifying welding areas (13') of the wiring bottom plates (13), block pins (10') facing an outside are formed at tails of the front ends of the connection wires (10), and each LED lighting chip (11), the welded points of the connection wires (10) at two corresponding sides thereof and the corresponding block pins (10') are tightly wrapped and plastic-packaged by a small insulation plastic body (5).

2. The novel LED lamp string according to claim 1, characterized in that: extending sections for connecting the wires (10) with the LED lighting chips (11) are downward sloped, and form a slope section (18).

3. The novel LED lamp string according to claim 2, characterized in that: more than one half of the slope section (18) is wrapped by the small insulation plastic body (5).

4. The novel LED lamp string according to claim 1, characterized in that: the connection wires (10) wrapped by insulation films are enameled wires.

5. The novel LED lamp string according to claim 1, characterized in that: the LED lighting chips (11) are strip-shaped, and long ends thereof are in same direction with the lamp string.

6. The novel LED lamp string according to claim 1, characterized in that: adjacent front ends of the connection wires (10) wrapped by the insulation films to be welded on same lighting LED chips (11) get close to the straight and flat center of the lower end surface of the wiring bottom plate (13).

7. The novel LED lamp string according to claim 1, characterized in that: the block pins (10') are formed by bending or cutting in a process of machining and disconnecting a whole connection wire.

8. The novel LED lamp string according to claim 1, characterized in that: the block pins (10') are clamping sections formed by flattening or clamping sections formed by bending and winding.

9. A hose lamp using the novel LED lamp string according to claim of 1, the hose lamp comprises a front connector (50), a tail plug (60), a hose (30) and at least one serial lighting LED lamp string (1) arranged in a through slot (35) of the hose (30), two main wires (32, 32') are plastic-packaged on the hose (30), the connection wires connected with two ends of the serial lighting LED lamp string (1) are respectively connected with the corresponding main wires (32, 32').

* * * * *